US011337481B2

(12) United States Patent
Krynock et al.

(10) Patent No.: US 11,337,481 B2
(45) Date of Patent: May 24, 2022

(54) HELMET WITH FOAM LAYER HAVING AN ARRAY OF HOLES

(71) Applicant: Specialized Bicycle Components, Inc., Morgan Hill, CA (US)

(72) Inventors: Michael Joseph Krynock, Morgan Hill, CA (US); Zachary Rosen, Morgan Hill, CA (US); Jason Walton, Campbell, CA (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 244 days.

(21) Appl. No.: 16/409,077

(22) Filed: May 10, 2019

(65) Prior Publication Data

US 2019/0343214 A1 Nov. 14, 2019

Related U.S. Application Data

(60) Provisional application No. 62/670,346, filed on May 11, 2018.

(51) Int. Cl.
*A42B 3/12* (2006.01)
*A42B 3/08* (2006.01)

(52) U.S. Cl.
CPC ..... *A42B 3/125* (2013.01); *A42B 3/08* (2013.01)

(58) Field of Classification Search
CPC .. A42B 3/10; A42B 3/12; A42B 3/124; A42B 3/125; A42B 3/128
See application file for complete search history.

(56) References Cited

U.S. PATENT DOCUMENTS 3,877,076 A 4/1975 Summers et al.
7,376,980 B2 5/2008 Bullock et al.
(Continued)

FOREIGN PATENT DOCUMENTS

DE 8423159 U1 11/1984
EP 2776244 A1 9/2014
WO 2017152151 A1 9/2017

OTHER PUBLICATIONS

European Patent Office Extended Search Report for Related Application No. 19173802.0 dated Aug. 30, 2019 (8 pages).

*Primary Examiner* — Sally Haden
(74) *Attorney, Agent, or Firm* — Micheal Best & Friedrich LLP

(57) ABSTRACT

A helmet includes an outer shell, a securing mechanism (e.g., a strap and belt system) for securing the shell to a user's head, and an impact-absorbing layer (e.g., expanded polystyrene (EPS), expanded polypropylene (EPP), or other suitable material) positioned on an inner surface of the outer shell. The impact-absorbing layer includes a resilient material and has an inner surface and a plurality of holes each having a hexagonal cross-sectional shape. The hexagonal holes may extend less than all the way through the impact-absorbing layer. A section of the impact-absorbing layer can have holes with a combined cross-sectional area that is at least 50% of a cross-sectional area of the inner surface of the impact-absorbing layer. the plurality of holes can define a honeycomb structure having cell walls having cell wall thicknesses, and the plurality of holes can have major diameters that are larger than the cell wall thickness of the cell walls.

21 Claims, 5 Drawing Sheets

(56) References Cited

U.S. PATENT DOCUMENTS

| | | | | |
|---|---|---|---|---|
| 7,930,771 | B2 | 4/2011 | Depreitere et al. | |
| 8,015,625 | B2 | 9/2011 | Grim et al. | |
| 8,863,319 | B2 | 10/2014 | Knight | |
| 9,032,558 | B2 | 5/2015 | Leon | |
| 9,220,310 | B2 | 12/2015 | Hawkins et al. | |
| 9,439,469 | B2 | 9/2016 | Phipps et al. | |
| 9,603,406 | B2 | 3/2017 | Halldin | |
| 9,795,179 | B2 | 10/2017 | Lytle | |
| 9,839,251 | B2 | 12/2017 | Pannikottu et al. | |
| 9,907,346 | B2 | 3/2018 | Hanson et al. | |
| 2004/0117896 | A1* | 6/2004 | Madey | A42B 3/12 2/411 |
| 2006/0059605 | A1 | 3/2006 | Ferrara | |
| 2015/0047110 | A1 | 2/2015 | Chilson | |
| 2016/0073723 | A1 | 3/2016 | Halldin et al. | |
| 2018/0027914 | A1 | 2/2018 | Cook | |
| 2019/0357623 | A1* | 11/2019 | Willinger | A42B 3/064 |

* cited by examiner

HELMET WITH FOAM LAYER HAVING AN ARRAY OF HOLES

CROSS-REFERENCE TO RELATED APPLICATIONS

This application claims priority to U.S. Provisional Application No. 62/670,346, filed May 11, 2018, the entire contents of which is incorporated herein by reference.

BACKGROUND

The present invention relates to helmets and more specifically to helmets that facilitate rotational impact absorption.

Modern helmets typically include an outer shell made from a hard plastic (e.g., polycarbonate), an impact-absorbing layer made of foam (e.g., expanded polystyrene (EPS)) secured to the inner surface of the outer shell, and an inner comfort layer on an inner surface of the impact-absorbing layer. Any of these layers can include vent holes that provide ventilation to the user, which is beneficial when the user partakes in an activity that causes overheating, such as a strenuous aerobic activity.

Some helmets are designed to facilitate rotation of the helmet relative to the user's head when a rotational impact is encountered. For example, helmets are known to include special sliding facilitators that absorb transmission of rotational energy from the helmet to the user's head. Such sliding facilitators are typically mechanical structures between the outer shell and the user's head (e.g., between the outer shall and the impact-absorbing layer, or between the impact-absorbing layer and the user's head).

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Some embodiments include a helmet comprising an outer shell, a securing mechanism (e.g., a strap and belt system) for securing the shell to a user's head, and an impact-absorbing layer (e.g., expanded polystyrene (EPS), expanded polypropylene (EPP), or other suitable material) positioned on an inner surface of the outer shell. The impact-absorbing layer comprises a resilient material and has an inner surface and a plurality of holes having a hexagonal cross-sectional shape. In many embodiments, the hexagonal holes do not extend all the way through the impact-absorbing layer.

In these or other embodiments, a section of the helmet has holes with a combined cross-sectional area that is at least 50% of the cross-sectional area of the entire inner surface of the impact-absorbing layer. In many embodiments, the holes define a honeycomb structure having cell walls each having a cell wall thickness, and wherein each of the holes has a major diameter that is larger than each of the cell wall thicknesses.

Other details and embodiments of the invention will become apparent by consideration of the detailed description and accompanying drawings.

Figure 1:
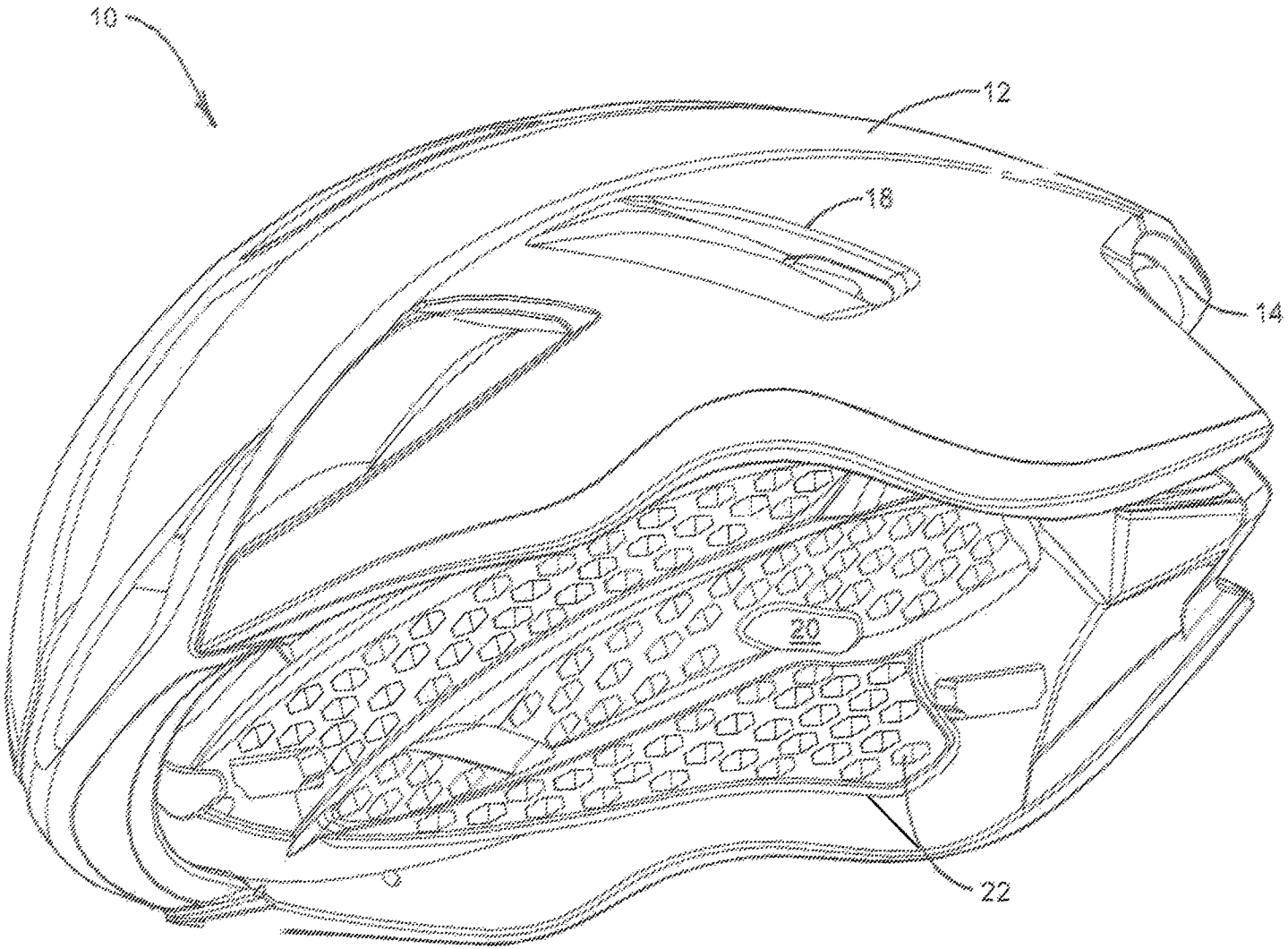
FIG. 1 is a perspective view of a helmet, according to an embodiment of the present invention.
Figure 1A:
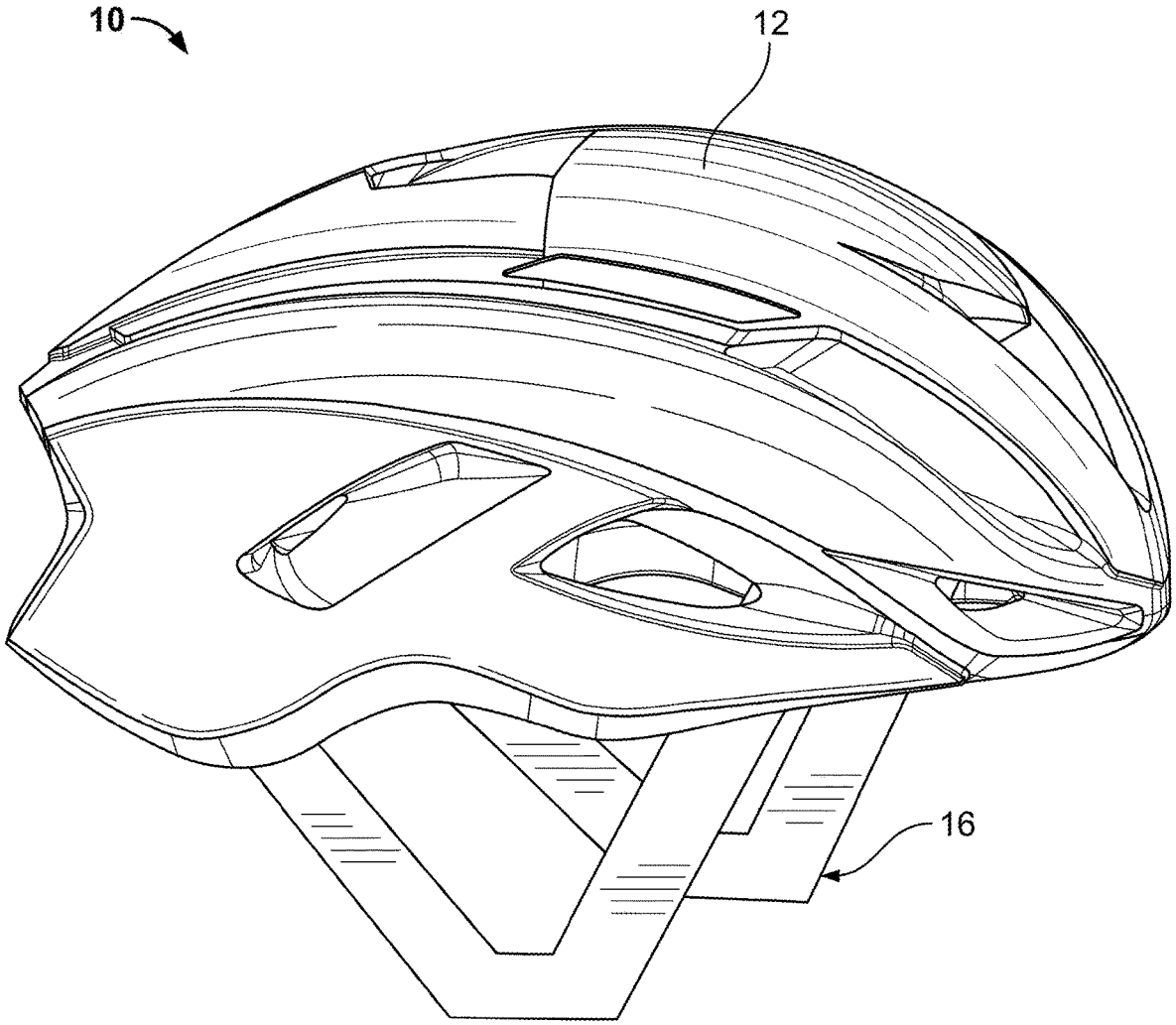
FIG. 1A is a perspective view of the helmet, illustrating a strap assembly.
Figure 2:
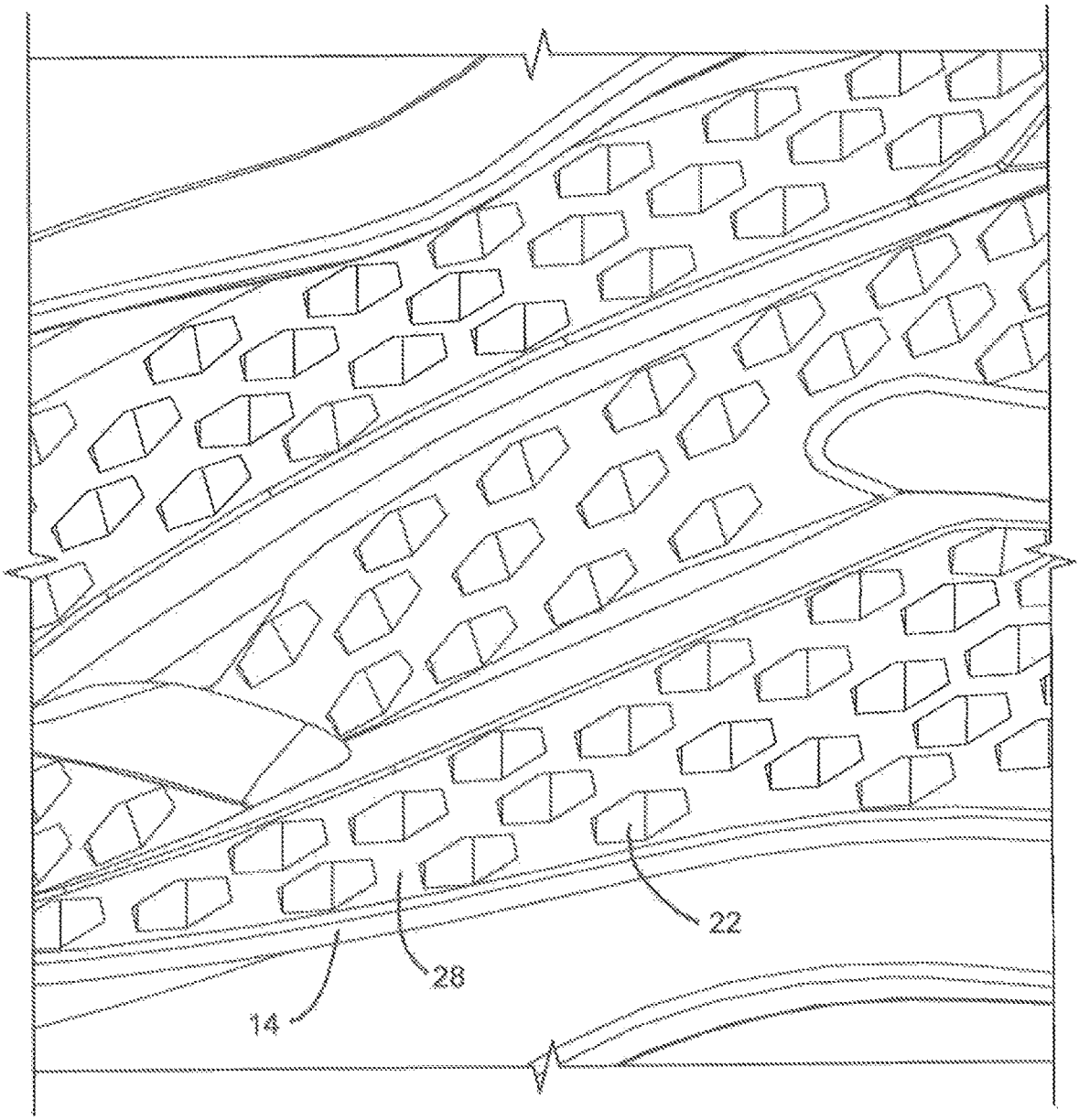
FIG. 2 is an enlarged view of a portion of the helmet of FIG. 1, showing an impact-absorbing layer with hexagonal cross-section holes.

Turning now to the drawings, FIGS. 1 and 1A illustrate a helmet 10 comprising an outer shell 12, an impact-absorbing layer 14, and a securing mechanism in the form of a strap assembly 16 (the strap assembly 16 illustrated only in FIG. 1A). The helmet 10 can be worn by a user to protect the head of the user, such as, for example, from physical trauma resulting from impacts to the head of the user. For example, in many embodiments, the helmet 10 can be a bicycle helmet.

The impact-absorbing layer 14 can be coupled (e.g., directly coupled) to an inner surface of the outer shell 12. In some embodiments, the impact-absorbing layer 14 can be mechanically coupled to the inner surface of the outer shell 12, such as, for example, by one or more fasteners. In these or other embodiments, the impact-absorbing layer 14 can be adhesively coupled to the inner surface of the outer shell 12. In some embodiments, the impact-absorbing layer 14 can be removable. In these or other embodiments, the impact-absorbing layer 14 can be replaceable, such as, for example, when the impact-absorbing layer 14 is damaged.

In many embodiments, the outer shell 12 can include a plurality of outer vents 18 extending through the outer shell 12. As shown in the illustrated embodiment of FIG. 1, in some embodiments, the impact-absorbing layer 14 can comprise a plurality of inner vents 20 aligned with the outer vents 18 to provide cooling to the user's head.

The strap assembly 16 is configured to secure the helmet 10 to a user's head. In many embodiments, the strap assembly 16 can comprise any suitable mechanism configured to secure the helmet 10 to a user's head. For example, U.S. Pat. No. 7,376,980, which is incorporated by reference in its entirety, discloses an exemplary mechanism that can be implemented for strap assembly 16. In these or other embodiments, helmet 10 further can comprise a belt assembly (not shown) that provides a snug fit between the helmet and a user's head to further secure the helmet 10 to the user's head. U.S. Pat. No. 8,015,625, which is hereby incorporate by reference in its entirety, discloses an exemplary belt assembly that can be implemented in connection with helmet 10.

In many embodiments, the outer shell 12 can comprise a hard, plastic material. For example, the hard, plastic material can comprise polycarbonate or another material having similar hardness or other properties.

As shown in the illustrated embodiment, in many embodiments, the impact-absorbing layer 14 comprises a resilient material. For example, the resilient material can comprise expanded polypropylene (EPP), which has been found to provide a good combination of impact absorption and resiliency. In these or other embodiments, the resilient material can comprise, for example, ethylene-vinyl acetate (EVA), expanded polystyrene (EPS), thermoplastic rubber (TPR), and/or expanded polyethylene (EPE).

Figure 3:
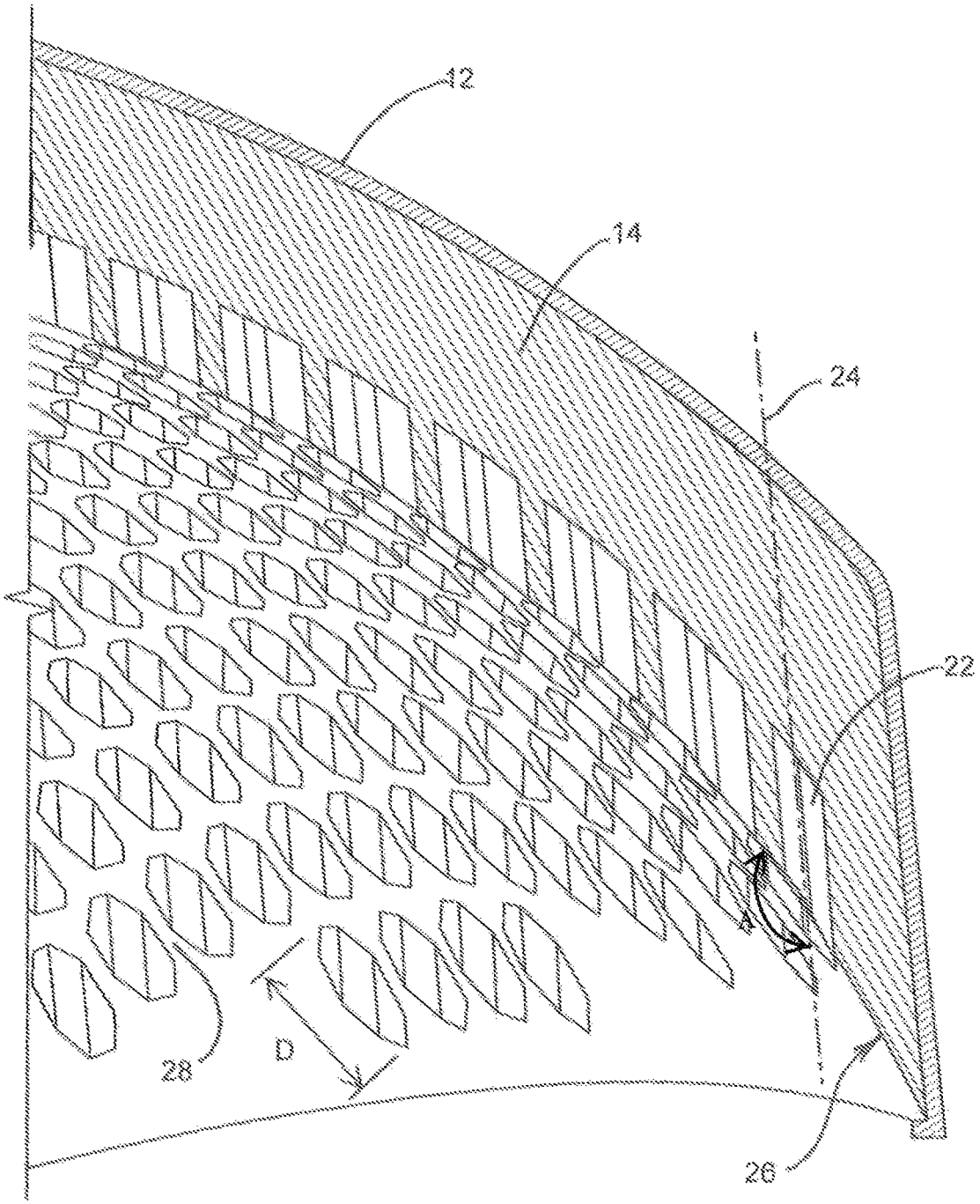
FIG. 3 is a partial cross-sectional view of the impact-absorbing layer, illustrating some of the holes extending up partially through the impact-absorbing layer from an inner surface of the impact-absorbing layer toward an outer shell of the helmet.
Figure 4:
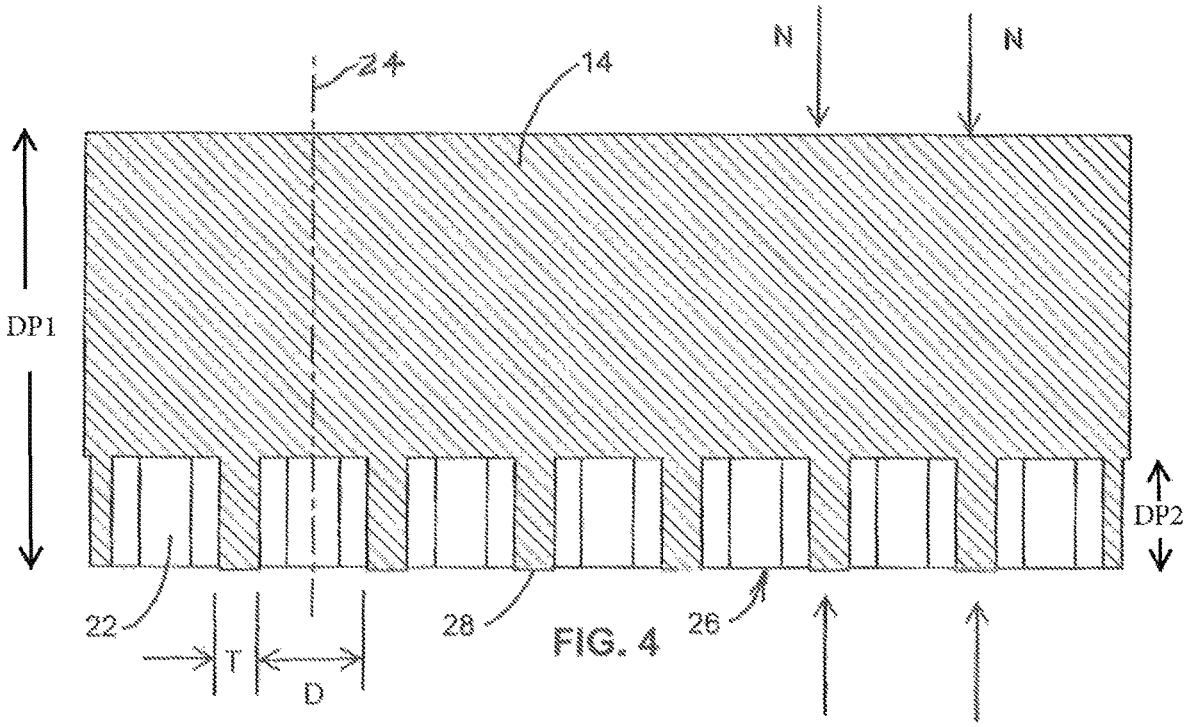
FIG. 4 is a cross-sectional view of the impact-absorbing layer, taken through a center (corner-to-corner) of a series of the holes, with the impact-absorbing layer under a normal force condition.

In many embodiments, the impact-absorbing layer 14 includes an inner surface 26 and a plurality of holes 22. The holes 22 can open at the inner surface 26 and extend into (e.g., through) the impact-absorbing layer 14. The holes 22 each can have a hexagonal cross-sectional shape, though in other embodiments, other polygonal shapes can be implemented (e.g., squares, rectangles, octagons, etc.). For example, the holes 22 can be spaced from each other to form a honeycomb wall structure in the inner surface 26 of the impact-absorbing layer 14. The holes 22 each define an axis 24 extending axially therethrough. In many embodiments, the axis 24 can be perpendicular to the inner surface 26 of the impact-absorbing layer 14, as shown in FIG. 4. However, in other embodiments, the axis 24 of the holes 22 can be oriented at an oblique angle "A" to the inner surface 26 of the impact-absorbing layer 14, as shown in FIG. 3. In some embodiments, the oblique angle of the axes 24 can vary between two or more of the holes 22. In further embodiments, some of the axes 24 of the holes 22 can be perpendicular to the inner surface 26 and some of the axes 24 can be oriented at an oblique angle to the inner surface 26.

In many embodiments, the impact-absorbing layer 14 advantageously can facilitate the absorption of energy resulting from forces acting on the helmet 10 (e.g., when something impacts the outside of the helmet 10). In many embodiments, the honeycomb pattern wall structure of the impact-absorbing layer 14 can permit the impact-absorbing layer 14 to facilitate the absorption of energy resulting from forces acting on the helmet 10. Further, the honeycomb pattern wall structure of the impact-absorbing layer 14 can permit the impact-absorbing layer 14 to facilitate the absorption of energy resulting from normal and shear or rotational forces acting on the helmet 10.

For example, referring to FIG. 4, the holes 22 are defined by cell walls 28. The cell walls 28, which surround and define the holes 22, can compress axially under a normal force N (i.e., roughly perpendicular to the inner surface 26 of the impact-absorbing layer 14) to absorb impacts on the helmet 10 in a direction perpendicular to the surface of the helmet 10 (e.g., the outer surface of outer shell 12). In addition, referring to FIG. 5, the cell walls 28 can flex laterally under a shear or rotational force R (i.e., roughly parallel to the inner surface 26 of the impact-absorbing layer 14) to absorb torsional or rotational impact on the helmet 10, such as, for example, when the impacting force is not perpendicular to the outside surface of the helmet 10. In some embodiments, each of the above-noted types of impacts, if of sufficient intensity, can result in permanent deformation of the cell walls 28, which can provide the user with a visual indication that the helmet 10 is damaged and should be replaced. Further, the deformations on the cell walls 28 can show the location(s) of impacts experience by the user, such as, for example, to be used in determining where the user experienced trauma.

Figure 5:
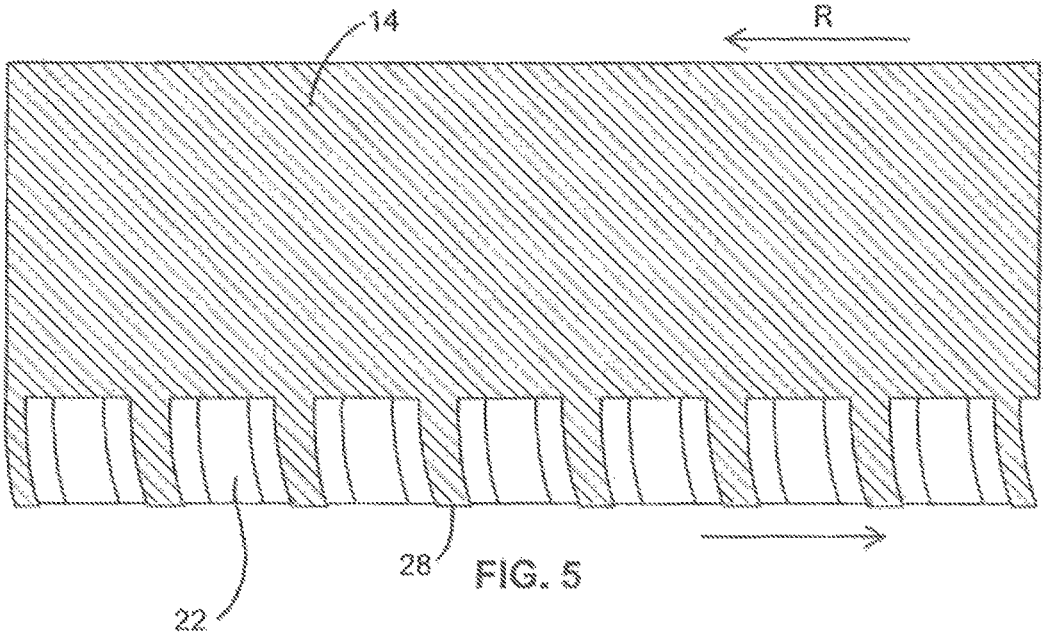
FIG. 5 is the cross-sectional view of FIG. 4, with the impact-absorbing layer under a rotational force condition.

With reference to FIGS. 3-5, it has been found that a hole major diameter D (i.e., a largest diameter or cross-sectional distance as measured across the hole 22 from one corner to an opposite corner) and a cell wall thickness T (which is dependent on the hole 22 spacing) affects the performance of the helmet 10, and can be varied depending on the material used. For example, a stiffer material can use a thinner cell wall 28 and/or larger holes 22 and hole major diameters D (wider spaced cell walls) than a more resilient material in order to achieve the same flex under a given torsional load. As a result, the hole size and spacing can vary considerably depending on the material being used. For example, in the illustrated embodiment or other embodiments, the major diameter D of the hole 22 is larger than the cell wall thickness T. The major diameter D can be approximately 3 millimeters to approximately 20 millimeters, and the cell wall thickness T can be approximately 1 millimeter to approximately 15 millimeters, or approximately 3 millimeters to approximately 12 millimeters. Other embodiments can include different values and ranges of the major diameter D and/or cell wall thickness T. For example, in some embodiments, the major diameter D can be less than or equal to the cell wall thickness T.

The size of the cell walls 28 and positioning of the cell walls 28 and holes 22 also can be based on a desired rotational movement of the impact-absorbing layer 14 during a rotational impact on the helmet 10. For example, the cell wall thickness T of a given hole 22 can depend upon how much movement of the impact-absorbing layer 14 is desired during a rotational impact at that location, as well as where the cell wall 28 is located along the helmet 10. Most heads and helmets generally have an oval shape. Movement (e.g., flexing as seen in FIG. 5) of the cell walls 28 in the impact-absorbing layer 14 generally can be easier along the sides of the head or helmet 10 than along the front and back of the helmet 10. Thus, in some embodiments, the helmet 10 can include one or more regions with cell wall thicknesses T that are smaller, and other regions where the cell wall thicknesses T are larger, to accommodate for different head shapes, and to facilitate a desired overall movement of the impact-absorbing layer 14 in the event of a rotational impact. Further, one helmet 10 may be different than another helmet 10, such as, for example, to accommodate different users. Thus, in some embodiments, the cell wall thickness T within the impact-absorbing layer 14 from helmet 10 to helmet 10 varies, depending upon a desired rotational movement of the impact-absorbing layer 14 for each particular helmet 10.

The cell wall thickness T also can vary along the hole 22 itself, or around the hole 22. For example, in some embodiments, the cell wall thickness T along a hole 22 (e.g., along the axis 24 as seen in FIG. 4) is constant along the entire hole 22, or varies. In some embodiments the cell wall thickness T can be smaller nearer the inner surface 26, and larger nearer the outer shell 12. In these or other embodiments, the cell wall thickness T can vary around the hole 22. For example, in some embodiments the cell wall thickness T can be larger on one side of the hole 22 than on another (e.g., opposite) side along the inner surface 26. Further, in some embodiments, the cell wall thicknesses or ranges of thicknesses T can be the same for all holes 22 in the helmet 10, or can vary. For example, in some embodiments one hole 22 can be surrounded by cell walls 28 with cell wall thicknesses T of a first value, whereas other holes 22 in the impact-absorbing layer 14 are surrounded by cell walls 28 with cell wall thicknesses T of a different value. Similarly, the sizes of the holes 22 themselves (e.g., the major diameters D) can also vary from hole 22 to hole 22. Thus, in some embodiments, the helmet 10 can include smaller holes 22 near a center of the helmet 10 (e.g., directly above a user's head, where little movement of the impact-absorbing layer 14 is desired) and larger holes 22 around the perimeter or sides of the helmet 10 (e.g., where more movement of the impact-absorbing layer 14 is desired).

With reference to FIG. 4, the impact-absorbing layer 14 also includes a depth DP1 (as measured for example along the axis 24 seen in FIG. 4, and along a direction that is perpendicular to the cell wall thickness T and major diameter D). For example, in some embodiments, DP1 can be approximately 22 millimeters to approximately 40 millimeters or more. Other embodiments include different values and ranges of values for the depth DP1. In some embodiments, the depth DP1 varies from region to region of the helmet. In some embodiments, the value of DP1 can be thicker for higher impacts and thinner for lower impacts.

The chosen size and spacing of the holes 22 results in the holes 22 having a void area relative to the overall area of the inner surface 26 of the impact-absorbing layer 14. In many embodiments, the combined area of the holes 22 at the inner surface 26 is more than 40%, 50%, or 60% of the overall area of the inner surface 26 of the impact-absorbing layer 14 in that section of the helmet. In other words, in some embodiments, the holes 22 take up greater than half of the inner surface 26 of the impact-absorbing layer 14, whereas the cell walls 28 between the holes 22 take up less than half of the inner surface 26 of the impact-absorbing layer 14.

With reference to FIG. 4, a depth DP2 (FIG. 4) of the holes 22 themselves may also be a variable that can affect the resiliency under torsional impact. For example, a deeper hole 22 will result in a deeper cell wall 28, which will generally be more resilient than a shallower hole 22. In some embodiments, one or more of the holes 22 can extend all the way through the impact-absorbing layer 14 (e.g., to the outer shell 12), thereby providing improved ventilation to the rider. In other embodiments, one or more or all of the holes 22 can extend only partially through the impact-absorbing layer 14, and does not extend to the outer shell 12. Depending on the other structural variables and material used for the impact-absorbing layer 14, hole depths DP2 of approximately 2 millimeters to approximately 12 millimeters, approximately 2 millimeters to approximately 10 millimeters, approximately 3 millimeters to approximately 12 millimeters, or other values and ranges of values can be used. The depth DP2 can be identical for every hole 22, or can vary. For example, in some embodiments, the depths DP2 of holes 22 near the center of the helmet are smaller than the depths DP2 of the holes 22 along the perimeter or sides of the helmet 10.

Also, the size, spacing, and/or depth of the holes 22, and the material used for the impact-absorbing layer 14 (e.g., density), can be varied across a given helmet 10. For example, in some embodiments, certain areas of the helmet 10 include a more resilient material, or larger, deeper holes 22 that are more widely spaced, while other areas of the helmet 10 are different (e.g., the opposite). Further, the impact-absorbing layer 14 can be more dense at certain locations than others. For example, in some embodiments the resilient material of the impact-absorbing layer 14 can be more dense along the center of the helmet, and less dense along the perimeter or sides of the helmet 10.

Various features and advantages of the invention are set forth in the following claims.

The invention claimed is:

1. A helmet comprising:

an outer shell;

a securing mechanism configured to secure the outer shell to a user's head; and an impact-absorbing layer positioned on an inner surface of the outer shell, wherein the impact-absorbing layer comprises a resilient material and has an inner surface and a plurality of holes, wherein each hole includes an axis that extends axially through the hole, and wherein for each hole the hole has a hexagonal cross-sectional shape along a plane that is perpendicular to the axis of the hole, wherein the plurality of holes define a honeycomb structure having cell walls having cell wall thicknesses (T), wherein each cell wall thickness (T) is measured along a direction perpendicular to the axis, wherein the impact-absorbing layer includes a first region with first cell wall thicknesses of the cell wall thicknesses (T), and a second region with second cell wall thicknesses of the cell wall thicknesses (T) different than the first cell wall thicknesses.

2. A helmet as claimed in claim 1, wherein the securing mechanism comprises a strap.

3. A helmet as claimed in claim 1, wherein the impact-absorbing layer comprises expanded polypropylene.

4. A helmet as claimed in claim 1, wherein in a section of the impact-absorbing layer, holes of the plurality of holes at the section of the impact-absorbing layer have a combined cross-sectional area that is at least 50% of a cross-sectional area of the inner surface of the impact-absorbing layer.

5. A helmet as claimed in claim 1, wherein each hole of the plurality of holes has a major diameter measured along a direction perpendicular to the axis of the hole.

6. A helmet as claimed in claim 5, wherein the major diameter is larger than the cell wall thickness.

7. A helmet as claimed in claim 5, wherein the major diameter is approximately 3 millimeters to approximately 20 millimeters.

8. A helmet as claimed in claim 7, wherein the cell wall thickness is approximately 3 millimeters to approximately 12 millimeters.

9. A helmet as claimed in claim 5, wherein each of the first cell wall thicknesses is approximately 3 millimeters to approximately 12 millimeters.

10. A helmet as claimed in claim 1, wherein for one of the plurality of holes, the cell wall thickness (T) of a cell wall varies along the axis of the hole.

11. A helmet as claimed in claim 10, wherein the cell wall thickness is smaller nearer the inner surface of the impact-absorbing layer than nearer the outer shell.

12. A helmet as claimed in claim 1, wherein one hole of the plurality of holes is partially defined by two cell walls of the cell walls, and wherein the cell wall thickness of a first cell wall of the two cell walls is different than the cell wall thickness of a second one of the two cell walls.

13. A helmet as claimed in claim 1, wherein the plurality of holes comprises major diameters, wherein the plurality of holes include first holes in a center of the impact-absorbing layer and second holes along sides of the impact-absorbing layer, and wherein major diameters of the first holes are smaller than major diameters of the second holes.

14. A helmet as claimed in claim 1, wherein the plurality of holes have depths extending at least partially through the impact-absorbing layer, wherein for each hole of the plurality of holes, the depth is measured along the axis of the hole.

15. A helmet as claimed in claim 14, wherein a depth of at least one hole of the plurality of holes extends entirely through the impact-absorbing layer.

16. A helmet as claimed in claim 14, wherein the depths are approximately 2 millimeters to approximately 12 millimeters.

17. A helmet as claimed in claim 14, wherein each depth of the depths is equal to each other.

18. A helmet as claimed in claim 14, wherein the plurality of holes include first holes in a center of the impact-absorbing layer and second holes along sides of the impact-absorbing layer, and wherein depths of the first holes are smaller than depths of the second holes.

19. A helmet as claimed in claim 1, the plurality of holes include first holes in a center of the impact-absorbing layer and second holes along sides of the impact-absorbing layer, and wherein the impact-absorbing layer is more dense at the center of the impact-absorbing layer than at the sides of the impact-absorbing layer.

20. The helmet as claimed in claim 1, wherein the cell walls are integrally formed as a single piece with a remainder of the impact-absorbing layer, and are made of the same resilient material as the remainder of the impact-absorbing layer, such that the cell walls are configured to flex laterally relative to the remainder of the impact-absorbing layer when subjected to a force that is parallel to the inner surface of the impact-absorbing layer.

21. The helmet as claimed in claim 1, wherein the cell wall thicknesses of the first region are larger than the cell wall thicknesses of the second region, wherein the first region includes a front of the helmet, and wherein the second region includes a side of helmet.

* * * * *